US007927426B2

(12) United States Patent
Baugh et al.

(10) Patent No.: US 7,927,426 B2
(45) Date of Patent: Apr. 19, 2011

(54) METHOD OF PIPELINE REMEDIATION WITH A SCOOP

(76) Inventors: Benton Frederick Baugh, Houston, TX (US); James R. Crawford, Lafayette, LA (US)

( * ) Notice: Subject to any disclaimer, the term of this patent is extended or adjusted under 35 U.S.C. 154(b) by 374 days.

(21) Appl. No.: 12/218,740

(22) Filed: Jul. 18, 2008

(65) Prior Publication Data

US 2010/0012151 A1 Jan. 21, 2010

(51) Int. Cl.
*B08B 9/04* (2006.01)

(52) U.S. Cl. ..... 134/8; 134/22.12; 15/3.52

(58) Field of Classification Search ..... 134/8, 22.11, 134/22.12, 42; 15/104.061, 104.062, 3.5, 15/3.51, 3.52; 166/384, 386, 387
See application file for complete search history.

(56) References Cited

U.S. PATENT DOCUMENTS 6,374,838 B1 * 4/2002 Baugh ..... 134/167 C

OTHER PUBLICATIONS

Benton Baugh, Jim Crawford, John Illeman Magazine—"Deepwater Technology" p. 92, Aug. 1998.

* cited by examiner

*Primary Examiner* — Michael Barr
*Assistant Examiner* — Saeed T Chaudhry

(57) ABSTRACT

A retrievable pig for cleaning blockage material from a pipeline, comprising a string of tubing within the pipeline from a proximate location at the entrance to the pipeline to a distal location within the pipeline, a pig assembly comprising a flexible cup which will collect pipeline blockage material, a seal which engages the internal bore of the pipeline being cleaned, and a connection to the distal end of the string of tubing; pushing the pig assembly with fluid in the annular area between the internal bore of the pipeline and the outer diameter of the string of tubing until the pig assembly engages the blockage material, and pumping a flow of fluid thru the internal string of tubing to a location beyond a portion of the blockage material, the flow of fluid urging the pig assembly and the portion of the blockage material towards the proximate location.

2 Claims, 1 Drawing Sheet

METHOD OF PIPELINE REMEDIATION WITH A SCOOP

CROSS REFERENCE TO RELATED PATENT APPLICATIONS

N/A

BACKGROUND OF THE INVENTION

The field of this invention is that of tools used for the cleaning of pipelines, especially the long extended reach pipelines in offshore areas. As hot production crude is produced from the reservoirs below the ocean floor up to the wellhead equipment at the ocean floor and then thru pipelines along the ocean floor, it is cooled by the relatively cool temperature of the ocean water. In deepwater, the temperature can be as cold as 35 degrees Fahrenheit.

A characteristic common to a majority of the oil produced is that there is a wax component to the oil which will deposit on the walls of the pipeline and become a solid at temperatures well above the 35 degrees Fahrenheit. In fact, some of the waxes become a solid at temperatures above 100 degrees Fahrenheit, and so can be deposited or plated on the internal diameters of the pipelines at any expected ambient temperature. The process is similar to discussions of blocking of the arteries of a human being, with a thicker coating building up with time. Some pipelines have become so plugged that more than 90% of the flow area is blocked with the waxes, or are simply plugged.

Typically, as the wall becomes layered with wax as the temperature of the oil goes below the solidification temperature of the particular waxes in the produced fluids. The waxes act as a sort of insulation to the flow in the pipeline, allowing it to maintain a higher temperature for a greater distance. The effect of this is to extend the distance along the pipeline to which the wax is plating onto the internal diameter of the pipeline.

A common cure for the wax plating out on the internal diameter of the pipeline is to insert a pig into the flow stream and let the pig remove some of the wax. A pig is typically a cylindrical or spherical tool which will brush against the internal diameter of the pipeline in hopes of removing the deposited waxes. In pipelines with a high incidence of deposited waxes, a regular maintenance of pigs is normally prescribed as a preventative to pipeline blockage.

One problem with the pigs is that the deposited waxes are relatively soft and contain a lot of oil. To some extent, the pigs actually compress the waxes against the wall and squeeze the oil out, leaving a harder and stronger wax remaining.

A second problem is that when the wax layer on the internal diameter of the pipe is too thick, sloughing off may occur. If the wax starts to separate from the wall and continues, the pig begins to literally plow a block of wax ahead of itself. This will continue driving more and more wax off the wall of the pipeline until the pressure of the pipeline will no longer be able to move the mass. At that time you have a full pipeline blockage, which cannot be moved by pressure from either end.

If you imagine that you have an 8" internal diameter pipeline which is plugged for 1000 feet, the volume of the plug would be over 2600 gallons of wax. Depending on the particular wax and cleaning chemicals, it would probably take 10 gallons of chemicals to remediate one gallon of wax, so that would be 26,000 gallons of expensive chemicals to buy. If the wax was 5 miles from the point of entry into the pipeline, it would take almost 70,000 gallons of chemicals in the pipeline just to get to the wax blockage to remediate it.

It is easy to understand the benefits of a system which would clean wax blockages mechanically, eliminating the need for the expensive chemicals.

SUMMARY OF THE INVENTION

The object of this invention is to provide a pig which can mechanically remove a wax blockage from a pipeline.

A second object of the present invention is to provide a pig which mechanically entrains a portion of a wax blockage within the pig for recovery.

A third object of the present invention is to provide a pig which is pushed to the location of a wax blockage by flow outside a connecting string of tubing and can take return flow up the string of tubing.

Another object of the present invention is to provide a pig which is returned to the location of entry into the pipeline at least partially by pumping down the string of tubing.

Another object of the present invention is to provide a pig which exhausts the fluids flowing down the string of tubing to the pig at a location downstream of the mechanically entrained wax.

DESCRIPTION OF THE PREFERRED EMBODIMENT

Figure 1:
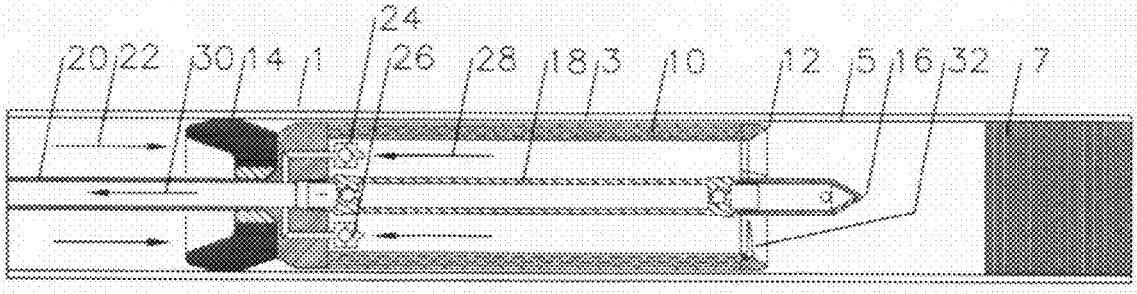
FIG. 1 is a section thru a pig of this invention moving in a pipeline towards the wax blockage.

Referring now to FIG. 1, the pig 1 is in a pipeline 3 with an internal diameter 5. The pig 1 is approaching a wax blockage 7. The pig 1 comprises a flexible scoop section 10, a front cutting edge 12, a pushing cup, 14, a spear nose 16, an internal flexible hose 18, and a connecting tubing string 20.

In FIG. 1 the pig 1 is moving to the right towards the wax blockage 7, and is propelled by the annular flow indicated at 22. As the wax blockage 7 is shown as completely blocking the bore of the pipeline 3, the volume of fluids in front of the pig goes thru check valves 24 and 26 and is indicated by arrows 28. It returns to the point that the connecting tubing string 20 entered the pipeline 3 as shown by arrow 30. Spring loaded dogs 32 are designed to fold down to allow wax material to enter the flexible scoop section 10, but to move back to the position as shown to prevent the wax material from leaving the scoop.

Figure 2:
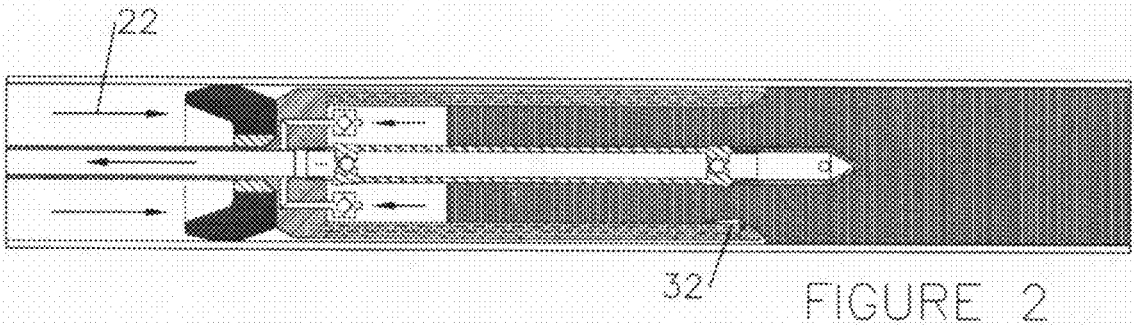
FIG. 2 is a section thru a pig of this invention engaged with the wax blockage.

Referring now to FIG. 2, the annular flow indicated at 22 has pushed the pig 1 into the wax blockage 7 a substantial amount. If tension was placed on the connecting tubing string 20 now, the wax may remain in place as the pig is pulled back. The spring loaded dogs 32 are intended to make sure the wax stays in the pig, however, with the nature of some waxes, this will not always be certain.

Figure 3:
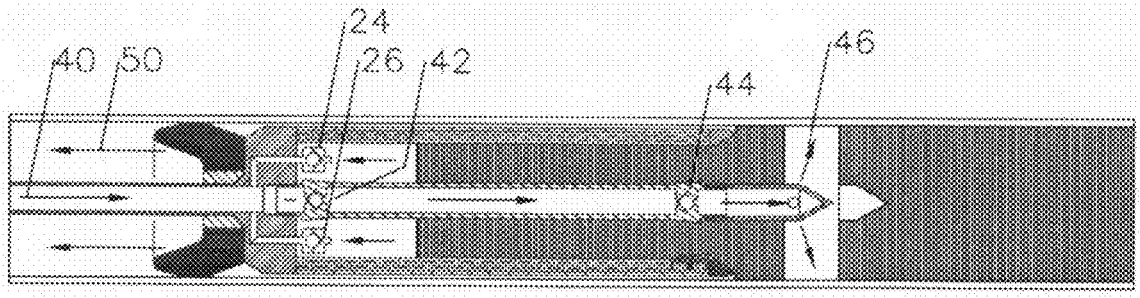
FIG. 3 is a section thru a pig of this invention pumping fluids downstream of a portion of the wax blockage and recovering the wax blockage.

Referring now to FIG. 3, the flow is reversed and flow is coming to the pig 1 thru the bore of the connecting tubing string 20 as shown at 40. The flow 40 cannot flow backwards thru the check valves 24 and 26, so it must flow instead thru check valves 42 and 44 and exit thru ports 46. By exiting at ports 46, the flow is downstream of the portion of wax to be recovered as shown as 48. Pumping fluid out ports 46 pushes the pig 1 back to where it entered the pipeline, with the fluids behind the pig 50 flowing back also.

In this way when a pig 1 makes a trip into the pipeline, it carries a specific load of wax 48 back to the surface without the need of special chemicals. Whatever liquid is in the pipeline is simply used as a working fluid and remains in the pipeline. The flexible scoop section 10 can be as long as desired to optimize the amount of wax being recovered on a trip into the pipeline. Repeated trips can be taken into the pipeline until all of the wax blockage is recovered.

The description preceding presumes that the flowline is entirely blocked as it is not usual to deploy a coiled tubing string to remediate partially blocked pipelines. The expense of the coiled tubing string and the chemicals conventionally used with coiled tubing strings has led to circulation only remediation methods. The present method requires the deployment of the coiled tubing string, but eliminates the cost of the chemicals, so may be economic in partially blocked pipelines also.

The foregoing disclosure and description of this invention are illustrative and explanatory thereof, and various changes in the size, shape, and materials as well as the details of the illustrated construction may be made without departing from the spirit of the invention.

We claim:

1. The method of cleaning blockage material from a pipeline, comprising providing a string of tubing within said pipeline from a proximate location at the entrance to the pipeline to a distal location within said pipeline, providing a pig assembly comprising:

a flexible cup which will collect pipeline blockage material, a seal which sealingly engages the internal bore of the pipeline being cleaned, a connection to the distal end of said string of tubing, pushing said pig assembly with fluid in the annular area between the internal bore of said pipeline and the outer diameter of said string of tubing until said pig assembly engages said blockage material, and pumping a flow of fluid thru said string of tubing to a location beyond a portion of said blockage material, said flow of fluid urging said pig assembly and said portion of said blockage material towards said proximate location, and opening spring loaded dogs to retain said portion of said blockage material within said flexible cup.

2. The method of cleaning blockage material from a pipeline, comprising providing a string of tubing within said pipeline from a proximate location at the entrance to the pipeline to a distal location within said pipeline, providing a pig assembly comprising:

a flexible cup which will collect pipeline blockage material, a seal which sealingly engages the internal bore of the pipeline being cleaned a connection to the distal end of said string of tubing, one or more check valves will permit flow of fluids from within said flexible cup into the bore of said string of tubing, one or more check valves which permit flow of fluids from within the bore of said tubing string to a location not within said flexible cup, pushing said pig assembly with fluid in the annular area between the internal bore of said pipeline and the outer diameter of said string of tubing until said pig assembly engages said blockage material, and pumping a flow of fluid thru said string of tubing to a location beyond a portion of said blockage material, said flow of fluid urging said pig assembly and said portion of said blockage material towards said proximate location, and opening spring loaded dogs to retain said portion of said blockage material within said flexible cup.

* * * * *